United States Patent [19]

Gross

[11] 4,131,966

[45] Jan. 2, 1979

[54] DOMESTIC CLEANING DEVICE

[76] Inventor: Jacob S. Gross, 541 Wythe Ave., Brooklyn, N.Y. 11211

[21] Appl. No.: 849,120

[22] Filed: Nov. 7, 1977

[51] Int. Cl.[2] ..... A46B 13/02

[52] U.S. Cl. ..... 15/28; 15/97 R; 51/170 T

[58] Field of Search ..... 15/23, 24, 28, 29, 22 R, 15/97; 51/170 PT, 170 T; 34/96, 239, 243 R; 310/50

[56] References Cited

U.S. PATENT DOCUMENTS

| | | | |
|---|---|---|---|
| 2,260,687 | 10/1941 | Lasha | 34/239 X |
| 2,702,395 | 2/1955 | Zaiger | 51/170 T X |
| 2,904,804 | 9/1959 | Odessey | 15/23 X |
| 3,173,417 | 3/1965 | Horner | 15/23 X |
| 3,343,192 | 9/1967 | Goldstein et al. | 15/23 |

*Primary Examiner*—Edward L. Roberts
*Attorney, Agent, or Firm*—Daniel Jay Tick

[57] ABSTRACT

A plurality of disc-type cleaning and polishing members are removably affixable to the shaft of an electric motor outside a housing for rotation by the motor. The cleaning and polishing members include a steel wool pad, a natural hair pad, a wire bristle member, a silver polisher, a sponge, a shoebrush, and the like. The housing has a fixed handle at one end thereof and a pistol grip handle pivotally mounted thereon intermediate the ends thereof for providing a grip for a second hand of a user.

1 Claim, 6 Drawing Figures

FIG. 1
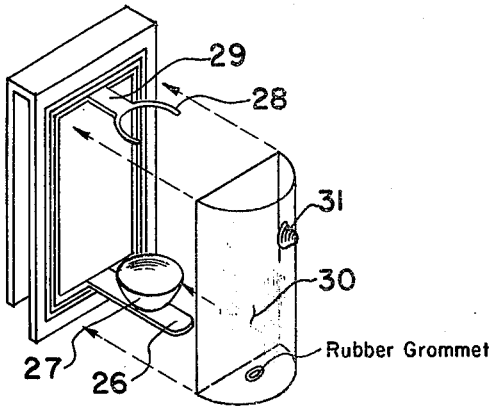
FIG. 2
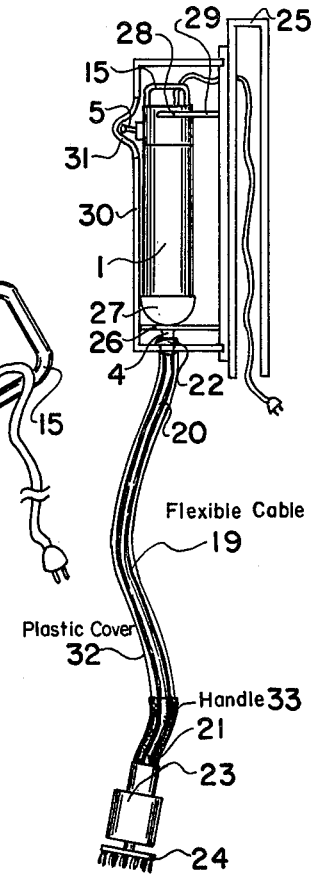
FIG. 3
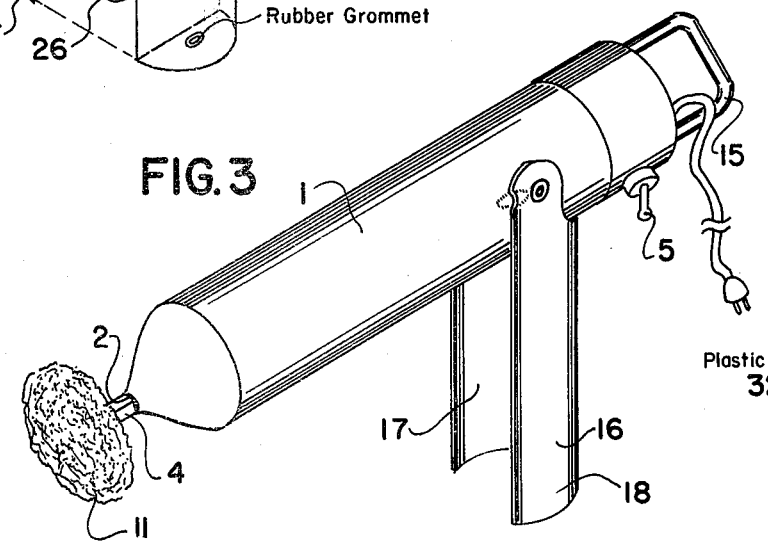
FIG. 4
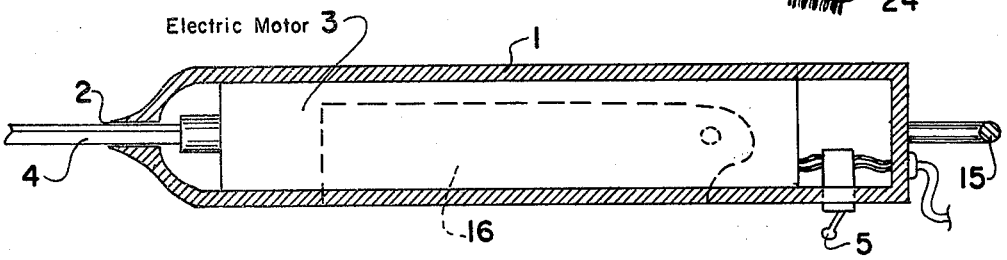
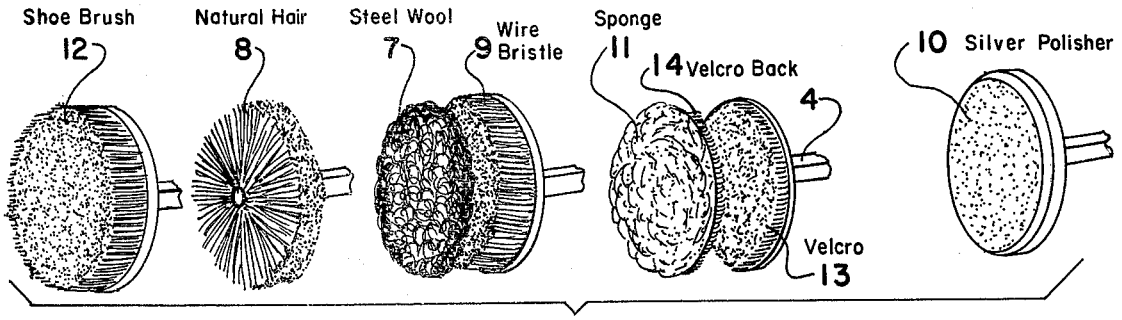
FIG. 5
FIG. 6
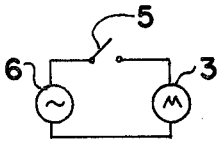

DOMESTIC CLEANING DEVICE

BACKGROUND OF THE INVENTION

The present invention relates to a domestic cleaning device. More particularly, the invention relates to a domestic cleaning device for cleaning and polishing pots, pans, kitchen utensils, eating utensils, appliances, surfaces, and the like.

A domestic cleaning device is disclosed in the following United States patents. U.S. Pat. Nos. 2,166,343, issued to Derks on July 18, 1939, 2,904,804, issued to Odessey on Sept. 22, 1959, 2,944,271, issued to Foster et al on July 12, 1960, 3,026,552, issued to Price on Mar. 27, 1962, 3,312,994, issued to Fassio on Apr. 11, 1967, 3,378,869, issued to Schwartz on Apr. 23, 1968, 3,380,093, issued to Hill on Apr. 30, 1968, 3,417,417, issued to Rhodes on Dec. 4, 1968 and 3,715,770, issued to Obregon-Gomez on Feb. 13, 1973.

Objects of the invention are to provide a domestic cleaning device of simple structure, which is inexpensive in manufacture, used with facility, convenience and safety, and functions efficiently, effectively and reliably to clean and polish pots, pans, kitchen utensils, eating utensils, appliances, dust and dirt-collecting surfaces, shoes, and the like.

BRIEF DESCRIPTION OF THE DRAWINGS

In order that the invention may be readily carried into effect, it will now be described with reference to the accompanying drawings, wherein:

FIG. 1 is an exploded perspective view of an embodiment of a mounting device for the domestic cleaning device of the invention;

FIG. 2 is a side view, partly in section, of the mounting device of FIG. 1;

FIG. 3 is a perspective view, on an enlarged scale, of an embodiment of the domestic cleaning device of the invention;

FIG. 4 is a cross-sectional view, on an enlarged scale, of the embodiment of FIG. 3;

FIG. 5 is a perspective view of a plurality of disc-type cleaning and polishing members of the domestic cleaning device of the invention; and FIG. 6 is a circuit diagram of the domestic cleaning device of the invention.

DETAILED DESCRIPTION OF THE INVENTION

The domestic cleaning device of the invention cleans and polishes pots, pans, kitchen utensils, eating utensils, appliances, surfaces, and the like.

The domestic cleaning device of the invention comprises a housing 1 having a hole 2 formed through one end thereof (FIGS. 2 to 4).

An electric motor 3 (FIGS. 4 and 6) of any suitable type is mounted in the housing 1 and has a shaft 4 extending through the hole 2 of the housing 1, as shown in FIGS. 2 to 4. The shaft 4 of the motor is preferably of square cross-section.

An ON-OFF switch 5 (FIGS. 2 to 4 and 6) is electrically connected between the motor 3 and a source of electrical energy 6, as shown in FIG. 6, and extends out of the housing 1, as shown in FIGS. 2 to 4, for manual operation thereof. The source of electrical energy 6 is preferably a commercial power source.

A plurality of disc-type cleaning and polishing members are affixable to the shaft 4 outside the housing 1 for rotation by the motor 3. As shown in FIG. 5, the cleaning and polishing members include a steel wool pad 7, a natural hair pad 8, a wire bristle member 9, a silver polisher 10, a sponge 11, a shoebrush 12, and the like. The cleaning and polishing members 7 to 12 may be removably affixed to the motor shaft 4 for rotation therewith via a Velcro fastener of which one half is in the form of a disc-like pad 13 affixed to, and rotatable with, said motor shaft, as shown in FIG. 5, and the other half 14 is affixed to, and extends from, the back of any of the pads or members 7 to 12.

A handle 15 extends from the housing 1 at an end opposite that having the hole 2 formed therethrough (FIGS. 2 to 4). The handle 15 provides a grip for a first hand of a user. A pistol grip handle 16 (FIGS. 3 and 4) is pivotally mounted on the housing 1 intermediate the ends thereof for providing a grip for the other hand of the user. The pistol grip handle 16 has a pair of partly cylindrical members 17 and 18 pivotally mounted on diametrically opposite ends of an axis through the housing 1, so that when it is not in use, it may be positioned alongside said housing, as shown by the broken lines in FIG. 4. The pistol grip handle 16 is held in either its extending position, shown in FIG. 3, or its retracted position shown in FIG. 4, by appropriate releasable fasteners of any suitable type such as, for example, corresponding protrusions of the parts 17 and 18 and of the housing 1.

In the modification of FIG. 2, a flexible cable 19 has spaced opposite first and second ends 20 and 21. The first end 20 of the flexible cable 19 is removably affixed to the motor shaft 4 via a first coupling device 22. The second end 21 of the flexible cable 19 has a second coupling device 23 for removably affixing it to a disc-type cleaning and polishing member 24 of the type shown in FIG. 5.

A mounting device, shown in FIGS. 1 and 2, releasably supports the domestic cleaning device of the invention in substantially upright position (FIG. 2). The mounting device comprises a mounting bracket 25 having a support arm 26 extending substantially perpendicularly therefrom and supporting a support cup 27 in which the bottom of the domestic cleaning device housing 1 rests. A C-type clamp 28 is supported perpendicularly from the mounting bracket in spaced parallel relation with the cup 27 via an arm 29 which is affixed to said mounting bracket and extends substantially perpendicularly therefrom in spaced parallel relation with the support arm 26. A waterproof housing 30 removably covers the mounting device and, more particularly, the domestic cleaning device mounted thereon. The waterproof housing 30 has a protruding portion 31 for accommodating the switch 5.

A plastic cover 32 is provided for the flexible cable 19 (FIG. 2) to protect the user from contact with said cable.

A long handle 33 is provided around the plastic cover 32 (FIG. 2) extending from the second coupling device 23 to prevent contact of the user's arm with the cable 19.

While the invention has been described by means of a specific example and in a specific embodiment, I do not wish to be limited thereto, for obvious modifications will occur to those skilled in the art without departing from the spirit and scope of the invention.

I claim:

1. A domestic cleaning device for cleaning and polishing pots, pans, kitchen utensils, eating utensils, appliances, surfaces, and the like, said domestic cleaning device comprising a housing having a hole formed through one end thereof;

an electric motor mounted in the housing and having a shaft extending through the hole thereof;

an ON-OFF switch electrically connected between the motor and a source of electrical energy and extending out of the housing for manual operation thereof;

a plurality of substantially disc-type cleaning and polishing members adapted to be individually removably affixable to the shaft outside the housing for rotation by the motor, said cleaning and polishing members including a steel wool pad, a natural hair pad, a wire bristle member, a silver polisher, a sponge, a shoe brush, and the like;

a flexible cable having spaced opposite first and second ends, the first end having first coupling means for removably affixing it to the shaft and the second end having second coupling means for removably affixing it to a disc-type cleaning and polishing member;

a handle extending from the housing at an end opposite that having the hole formed therethrough for providing a grip for a first hand of a user;

a pistol grip handle pivotally mounted on the housing intermediate the ends thereof for providing a grip for a second hand of a user, said pistol grip handle having a pair of partly cylindrical members pivotally mounted on diametrically opposite ends of an axis through the housing and having a retracted position alongside said housing and an extended position;

mounting means for releasably supporting said domestic cleaning device in substantially upright position; and a waterproof housing removably covering said mounting means and said device mounted on it with said cable extending from said mounting means whereby an item spaced from said mounting device is cleanable via said cable and a disc-type cleaning and polishing member removably affixed to said cable.

* * * * *